US010072678B2

(12) United States Patent
Holter et al.

(10) Patent No.: US 10,072,678 B2
(45) Date of Patent: Sep. 11, 2018

(54) REGENERATION DEACTIVATION VALVE AND METHOD

(71) Applicants: Ben Holter, New Berlin, WI (US); Chris Urban, New Berlin, WI (US); Corey Quinnell, West Allis, WI (US)

(72) Inventors: Ben Holter, New Berlin, WI (US); Chris Urban, New Berlin, WI (US); Corey Quinnell, West Allis, WI (US)

(73) Assignee: HUSCO International, Inc., Waukesha, WI (US)

( * ) Notice: Subject to any disclaimer, the term of this patent is extended or adjusted under 35 U.S.C. 154(b) by 397 days.

(21) Appl. No.: 14/747,498

(22) Filed: Jun. 23, 2015

(65) Prior Publication Data

US 2015/0369260 A1 Dec. 24, 2015

Related U.S. Application Data

(60) Provisional application No. 62/015,620, filed on Jun. 23, 2014.

(51) Int. Cl.
*F15B 11/024* (2006.01)
*F15B 13/04* (2006.01)

(52) U.S. Cl.
CPC ..... *F15B 11/024* (2013.01); *F15B 13/0403* (2013.01); *F15B 2011/0243* (2013.01); *F15B 2211/50563* (2013.01); *Y10T 137/7842* (2015.04); *Y10T 137/86493* (2015.04)

(58) Field of Classification Search
CPC ..... F15B 2011/0243; F15B 13/0403
See application file for complete search history.

(56) References Cited

U.S. PATENT DOCUMENTS

| | | | | |
|---|---|---|---|---|
| 3,267,961 | A * | 8/1966 | Rice | F15B 11/024 137/102 |
| 5,065,664 | A * | 11/1991 | Ohta | F15B 11/024 60/474 |
| 5,479,778 | A * | 1/1996 | Toyooka | E02F 9/2246 417/34 |
| 5,862,831 | A | 1/1999 | Chung et al. | |
| 7,337,807 | B2 * | 3/2008 | Koo | F15B 13/021 137/625.66 |
| 2004/0137549 | A1 | 7/2004 | Sasatsu et al. | |

* cited by examiner

*Primary Examiner* — F. Daniel Lopez
(74) *Attorney, Agent, or Firm* — Quarles & Brady LLP

(57) ABSTRACT

Systems and methods use selective regeneration to aid in controllability and efficiency of a hydraulic circuit. A regeneration deactivation valve can react to a differential pressure when the function is in free air and at risk of cavitating or when then function is doing positive work and needs to be efficient. When the function is at risk of cavitating, the regeneration deactivation valve can react to the potential for cavitation and the regeneration deactivation valve closes so the function regenerates. The regeneration deactivation valve can also react when the function is not at a risk of cavitating and can open up allowing the function to move with more power and efficiency.

26 Claims, 5 Drawing Sheets

REGENERATION DEACTIVATION VALVE AND METHOD

CROSS-REFERENCE TO RELATED APPLICATIONS

This application claims priority to U.S. Provisional Patent Application Ser. No. 62/015,620, filed on Jun. 23, 2014, and entitled "REGENERATION DEACTIVATION VALVE," which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems that control operation of a hydraulic cylinder, and more particularly to a valve arrangement and method incorporating a regeneration function for controlling operation of such a hydraulic cylinder.

2. Description of the Related Art

In excavating machinery and other heavy equipment and equipment hydraulically controlled generally, controllability and efficiency are several metrics that can be used to quantify the profitability and operator "feel" of the machine.

As a normal machine metric, operators can test for cavitation of functions. Cavitation is an unwanted condition that can occur when a function has an overrunning load. In an excavator, for example, the hydraulic cylinder used to control the excavator arm is susceptible to cavitation due to the arm having a large amount of potential energy when it is fully out, and the cylinder has a rather large cylinder area to fill with hydraulic fluid as the arm comes in towards the excavator.

One method to keep the arm from cavitating is to use regeneration of the arm cylinder where some of the rod exhaust fluid is pushed back into the head of the cylinder to help makeup (regenerate) fluid as the head chamber is expanding. This requires a connection from the rod side of the cylinder to the head side of the cylinder and normally a smaller connection from the rod side of the cylinder to the tank.

However, when the excavator is digging, the head side of the cylinder can have a higher pressure then the rod side of the cylinder, which does not allow for regeneration. Therefore, all of the rod fluid must go to tank through the smaller rod side to tank connection. This causes a large differential pressure across the control valve, which results in a high rod side pressure. This rod side pressure works against the head side pressure when digging, which reduces the force and efficiency of the machine.

Hydraulic circuits have attempted to better control the regeneration function by sensing pressure at the fluid source to determine if regeneration should occur. Based on the sensed pressure at the fluid source, the circuit can open a secondary passage to reduce the differential pressure across the control valve. Yet, these circuits still fail to provide better control for regenerating as the sensed pressure at the fluid source does not always provide the appropriate pressure value for determining when regeneration should occur.

Therefore, there is a desire to provide an improved valve arrangement incorporating a regeneration function for controlling operation of such a hydraulic cylinder.

SUMMARY OF THE INVENTION

The present technology overcomes the aforementioned drawbacks by providing systems and methods that use selective regeneration to aid in controllability and efficiency of a hydraulic circuit. A regeneration deactivation valve according to the present technology can "sense," i.e., react to a differential pressure, when the function is in free air and the function's cylinder is at risk of cavitating or when then function is doing positive work and the function's cylinder is not at risk of cavitation. When the cylinder is at risk of cavitating, the regeneration deactivation valve can react to the potential for cavitation by closing, or opening, a fluid path so the cylinder regenerates. The regeneration deactivation valve can also react when the cylinder is not at a risk of cavitating and can open up, or close, a fluid path allowing the function to move with more power and efficiency.

In accordance with one embodiment of the invention, a hydraulic regeneration deactivation valve is disclosed to deactivate regeneration of a hydraulic cylinder. The hydraulic regeneration deactivation valve comprises a body including a tank return node for connection to a tank, a driving workport for connection to a first chamber of the hydraulic cylinder, a return workport for connection to a second chamber of the hydraulic cylinder, the first chamber and the second chamber separated by a piston, and a regeneration node, the regeneration node for connection to the driving workport and for connection to the return workport. A flow control valve is received in the body and having a first fluid path between the regeneration node and the tank return node, the first fluid path being substantially unrestricted in a first flow control valve position, and the first fluid path being restricted in a second flow control valve position. And the flow control valve is responsive to a sense pressure in the driving workport to move between the first flow control valve position and the second flow control valve position.

In accordance with another embodiment of the invention, a hydraulic control valve is disclosed. The hydraulic control valve comprises a control valve body having a spool bore therein and a node for connection to a fluid source, a tank return node for connection to a tank, a driving workport for connection to a first chamber of the hydraulic cylinder, a return workport for connection to a second chamber of the hydraulic cylinder, the first chamber and the second chamber separated by a piston, and a regeneration node, the regeneration node for connection to the driving workport and for connection to the return workport. A spool is slidably received in the spool bore and having a spool first position in which a first fluid path is provided between the node and the driving workport, a spool second position in which a second fluid path is provided between the driving workport and the tank return node, and a spool neutral position in which the driving workport is closed off from both the node and the tank return node. A flow control valve is slidably received in the spool bore and having a first fluid path between the regeneration node and the tank return node when the spool is in the spool first position, the first fluid path being substantially unrestricted in a first flow control valve position, and the first fluid path being restricted in a second flow control valve position. And the flow control valve is responsive to a sense pressure in the driving workport to move between the first flow control valve position and the second flow control valve position.

To the accomplishment of the foregoing and related ends, the technology, then, comprises the features hereinafter fully described. The following description and the annexed drawings set forth in detail certain illustrative aspects of the technology. However, these aspects are indicative of but a few of the various ways in which the principles of the technology can be employed. Other aspects, advantages and novel features of the technology will become apparent from the following detailed description of the technology when considered in conjunction with the drawings.

Figure 1:
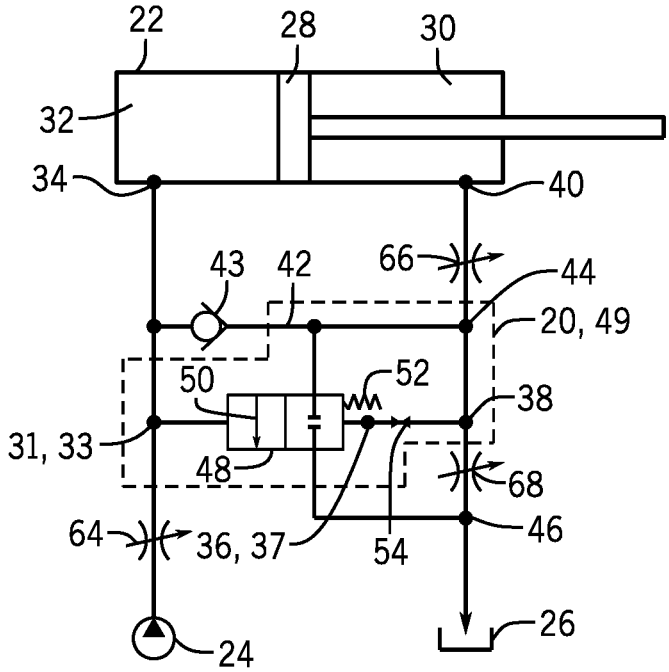
FIG. 1 illustrates a schematic of a hydraulic circuit including a regeneration deactivation valve according to embodiments of the technology.

While the technology is susceptible to various modifications and alternative forms, specific embodiments thereof have been shown by way of example in the drawings and are herein described in detail. It should be understood, however, that the description herein of specific embodiments is not intended to limit the technology to the particular forms disclosed, but on the contrary, the intention is to cover all modifications, equivalents, and alternatives falling within the spirit and scope of the technology as defined by the appended claims.

DETAILED DESCRIPTION OF THE INVENTION

The term "directly connected" means that the associated components are connected together by a conduit without any intervening element, such as a valve, an orifice or other device, which restricts or controls the flow of fluid beyond the inherent restriction of any conduit.

As used herein, the term "hydraulic cylinder" generically refers to a hydraulic actuator that comprises a cylinder body in which a piston moves in response to hydraulic fluid being fed into and drained from the cylinder body and in which a rod is connected to the piston so as the extend from and retract into the cylinder as the piston moves.

Reference herein to directional relationships and movement, such as raise and lower or left and right, refer to the relationship and movement of components in the orientation illustrated in the drawings and on the exemplary application of the invention being described, and other relationships and orientations of the components may exist in other applications of the present invention.

Although the inventive concepts can be described in the context of a hydraulic cylinder usable on heavy machinery such as a front end loader of an excavator, for example, the concepts described herein have broad applicability to controlling a variety of hydraulic devices, such as a hydraulic motor, as a non-limiting example.

With reference to FIG. 1, an exemplary embodiment of the technology includes a regeneration deactivation valve 20 connected in a hydraulic circuit including a cylinder 22, a fluid source 24, and a tank 26. The cylinder 22 includes an internal bore in which a piston 28 is slidably received, thereby forming a rod chamber 30 and a head chamber 32 within the cylinder 22 on opposite sides of the piston 28. The regeneration deactivation valve 20 includes a flow control valve 48 in a body 49, the flow control valve 48 able to react to a differential pressure between a sense pressure 31 at supply node 33, which can be directly connected to the driving workport 34, and a reference pressure 36 at node 37, which in some embodiments can be connected or directly connected to a regeneration gallery 38, to function according to what type of machinery operation is being done. The reference pressure 36 can be the same pressure as the return workport 40 or lower, for example. It is to be appreciated that the body 49 is shown generally in relation to the regeneration deactivation valve 20 as the body 49 can take any applicable shape.

When at risk of cavitating, the function can be overrunning, and in the case of an arm on an excavator, for example, the reference pressure 36, such as at the regeneration gallery 38, can be at a higher pressure than the sense pressure 31 at the driving workport 34. In this example, the regeneration deactivation valve 20 can react to the higher reference pressure 36 by restricting or closing a fluid path including a regeneration node 44 to a tank return node 46, so the function regenerates by allowing fluid to flow from the rod chamber 30 through the return workport 40, through a regeneration fluid path 42, through the driving workport 34, and to the head chamber 32. The regeneration fluid path 42 can include a check valve 43 to prevent the reverse flow of fluid from the head chamber 32 to the rod chamber 30. In some embodiments, the regeneration fluid path can also include a variable orifice 66 to meter the flow from the return workport 40.

When digging, such as with the case of the arm on an excavator, for example, the regeneration deactivation valve 20 can react to a higher sense pressure 31 at the driving workport 34 than the reference pressure 36 by opening or substantially unrestricting the fluid path including the regeneration node 44 to the tank return node 46, which allows for a low differential pressure across a restriction 50 (see FIGS. 1 and 3) in the regeneration deactivation valve 20, and creating a low pressure at return workport 40 and an improved efficient dig.

As seen in FIG. 1, in some embodiments, the flow control valve 48 can include a spring 52. The preload and rate of the spring 52 can be controlled to help bias the regeneration deactivation valve 20 closed and make for a stable transition from open to closed. Also, in some embodiments, an orifice 54 can be added between regeneration node 44 and the reference pressure 36 at node 37. This can make for a more stable transition from closed to open or from open to closed. In addition to orifice 54, orifice 56 (see FIGS. 5 and 8) can be added connecting the reference node 37 to the tank return node 46 and creating a pressure divider. In this arrangement, as pressure in the regeneration gallery 38 changes, the reference pressure 36 will follow, but at a lower level based on the relative sizes of orifice 54 and orifice 56.

Figure 2:
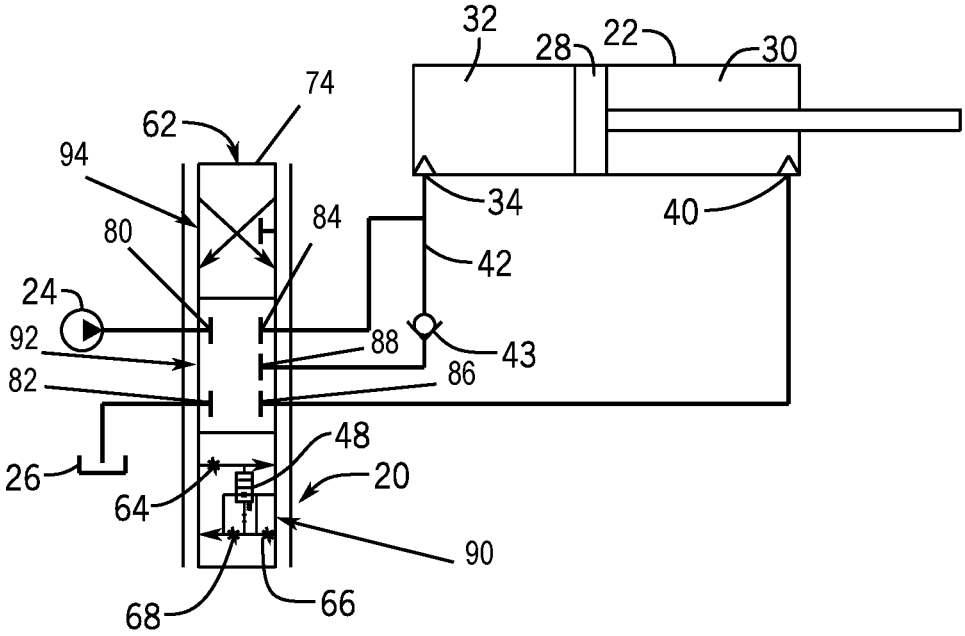
FIG. 2 illustrates a schematic of a control valve in a hydraulic circuit, the control valve including a regeneration deactivation valve according to embodiments of the technology.
Figure 3:
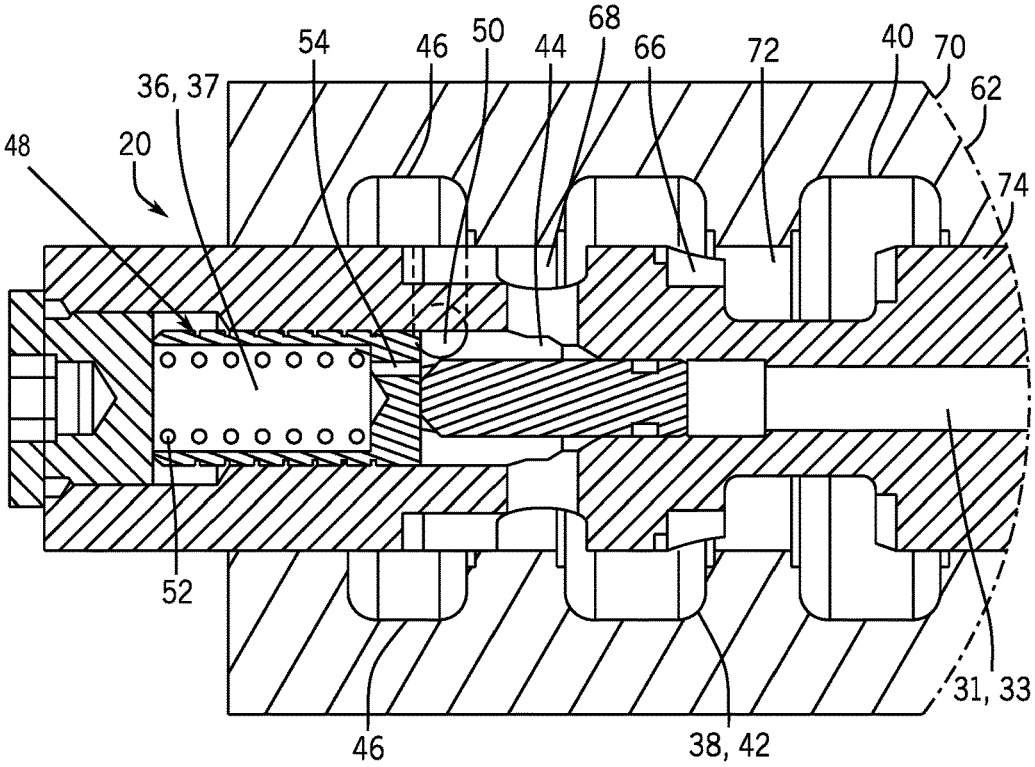
FIG. 3 depicts a close-up view of the construction of an embodiment of the regeneration deactivation valve as shown in FIG. 2.

Referring to FIGS. 2 and 3, the regeneration deactivation valve 20 is shown incorporated into an exemplary control valve 62. It is to be appreciated that the regeneration deactivation valve 20 can be a standalone device as shown in FIG. 1 in body 49, or the regeneration deactivation valve 20 can be integrated with the control valve 62. The control valve 62 is shown including a control valve body 70 having a spool bore 72, with a spool 74 in the spool bore 72, and variable orifices 64, 66, and 68 on the spool 74 (see FIG. 3). Variable orifice 64 serves to meter flow from the fluid source 24 to the driving workport 34. Variable orifice 66 serves to meter flow from the return workport 40, and variable orifice 68 serves to meter flow to the tank 26. When the regeneration deactivation valve 20 is a standalone device, variable orifices 64, 66, and 68 can be included in a hydraulic circuit to control the cylinder 22, as can be seen in FIG. 1. In some embodiments, the tank node 46 may be arranged within the control valve body 70 of the control valve 62 (see, e.g., FIG. 3).

In the illustrated embodiment, the control valve body 70 can include an inlet 80, an outlet 82, a first workport 84, a second workport 86, and a regeneration workport 88. The inlet 80 can be in fluid communication with the pump 24. The outlet 82 can be in fluid communication with the tank 26. The first workport 84 and the regeneration workport 88 can be in fluid communication with the head chamber 32, and the second workport 86 can be in fluid communication with the rod chamber 30. The regeneration node 44 can be arranged within the control valve body 70 and can provide fluid communication between the second workport 86 and the regeneration workport 88.

The spool 74 can be selectively movable within the spool bore 72 between a spool first position 90, a spool neutral position 92, and a spool second position 94. In the spool first position 90, the spool 74 can provide a first metered fluid path between the inlet 80 and the first workport 84, a second metered fluid path between the second workport 86 and the regeneration workport 88 through the regeneration node 44, a third metered fluid path between the second workport 86 and the outlet 82, and a flow control path between the second workport 86 and the outlet 82 arranged in parallel with the third metered fluid path. Thus, in the spool first position 90, fluid flowing from the rod chamber 30 can either flow from the second workport 86 to the regeneration workport 88, or from the second workport 86 to the outlet 82 via the third metered fluid path and/or the flow control path, depending on the pressure at the first workport 84, the position of the flow control valve 48, and the restriction of the variable orifice 68. In any case, in the spool first position 90, fluid flowing from the rod chamber 30 can pass through the regeneration node 44. In some embodiments, the regeneration path 42 can be in fluid communication with the regeneration node 44, and the regeneration path 42 can extend from the regeneration workport 88 to the driving workport 34 and thereby to the head chamber 32. In the illustrated embodiment, each of the first metered fluid path, the metered second fluid path, and the third metered fluid path can be selectively restricted to provide metering of the fluid flow therealong. Metering of the fluid flow along the first fluid path can be provided by the variable orifice 64. Metering of the fluid flow along the second fluid path can be provided by the variable orifice 66. Metering of the fluid flow along the third fluid path can be provided by the variable orifice 68.

In the spool neutral position 92, fluid communication can be inhibited between all of the inlet 80, the outlet 82, the first workport 84, the second workport 86, and the regeneration workport 88. In other words, in the spool neutral position 92, the driving workport 34 and the return workport 40 are both closed off from all of the supply node 33, the regeneration node 44, and the tank return node 46. In the spool second position 94, the spool 74 can provide a fourth fluid path between the inlet 80 and the second workport 86, a fifth fluid path between the first workport 84 and the outlet 82, and the second fluid path is closed (i.e., fluid communication is inhibited between the regeneration workport 88 and all of the inlet 80, the outlet 82, the first workport 84, and the second workport 86). Since the head chamber 32 can receive pressurized fluid from the pump 24 in the spool first position 90 via the first metered fluid path and the rod chamber 30 can receive pressurize fluid from the pump 24 in the spool second position 94 via the fourth fluid path, the cylinder 22 and the piston 28 can act as a double-acting hydraulic actuator as would be appreciated by one of skill in the art.

In the illustrated embodiment, the flow control valve 48 can be arranged on the flow control path within the spool 74 and can be selectively movable between a flow control first position where flow control valve 48 provides a first restriction and a flow control second position where the flow control valve 48 provides a second restriction less than the first restriction. The flow control valve 48 can movable between the first flow control position and the second flow control position in response to a pressure at the first workport 84, which is connected to the driving workport 34.

In FIG. 3, the regeneration deactivation valve 20 is shown in a non-regenerating open position, such that the regeneration gallery 38 is connected to tank 26 (not shown in FIG. 3) through the fluid path including the regeneration node 44 to the tank return node 46.

FIGS. 4-10 show alternative embodiments of a regeneration deactivation valve connected to a cylinder 22, a source of fluid 24, and a tank 26. Each regeneration deactivation valve can be the same as the regeneration deactivation valve 20, other than restrictive elements can be added to or removed from the hydraulic circuit to influence performance.

Figure 4:
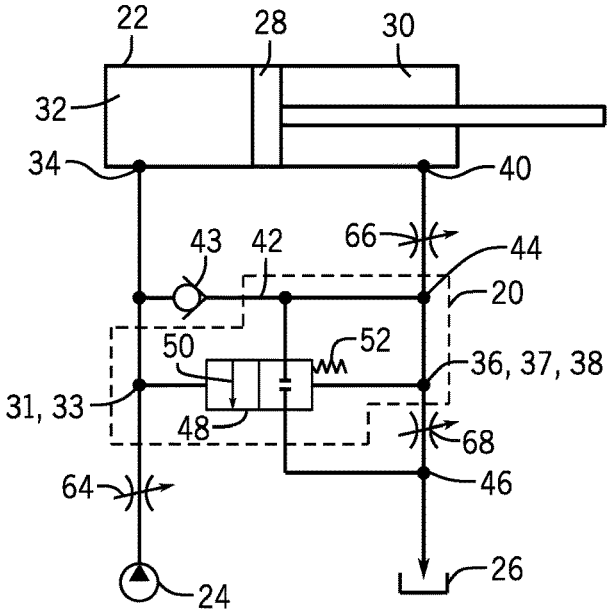
FIGS. 4-10 illustrate schematic views of a hydraulic circuit including alternative embodiments of a regeneration deactivation valve according to embodiments of the technology.

FIG. 4 is similar to FIG. 1, except orifice 54 has been removed. Orifice 54 (without orifice 56, discussed below) serves as a damping orifice. In other words, it serves to slow down the flow control valve velocity when the valve is transitioning from one position to the next.

Figure 5:
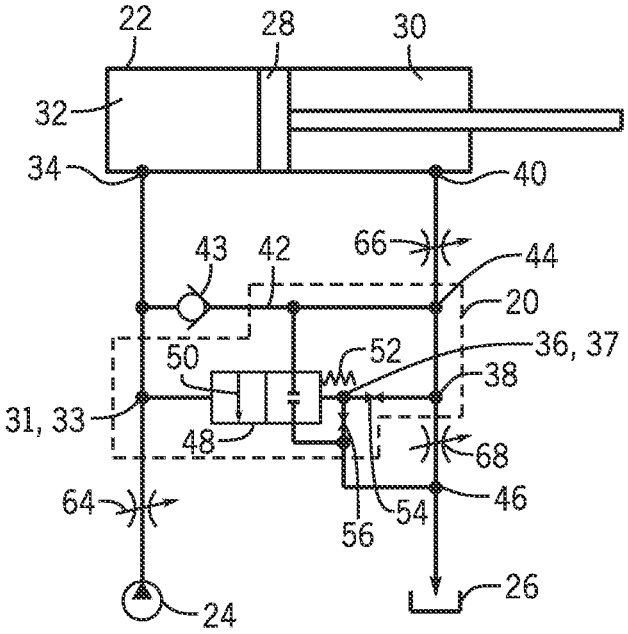

FIG. 5 is similar to FIG. 1, except orifice 56 has been added. The two orifices in series (54 and 56) set up a flow path from the reference node 37 to the tank return node 46 and create a pressure divider. In some embodiments, when the orifices are fixed, then there is a ratio-metric relationship between the pressure drop from regeneration gallery 38 to reference pressure 36 as a function of the pressure drop between regeneration gallery 38 and the tank return node 46. In other words, as pressure in the regeneration gallery 38 changes, the reference pressure 36 will follow, but at a lower level based on the relative sizes of orifice 54 and orifice 56.

Figure 6:
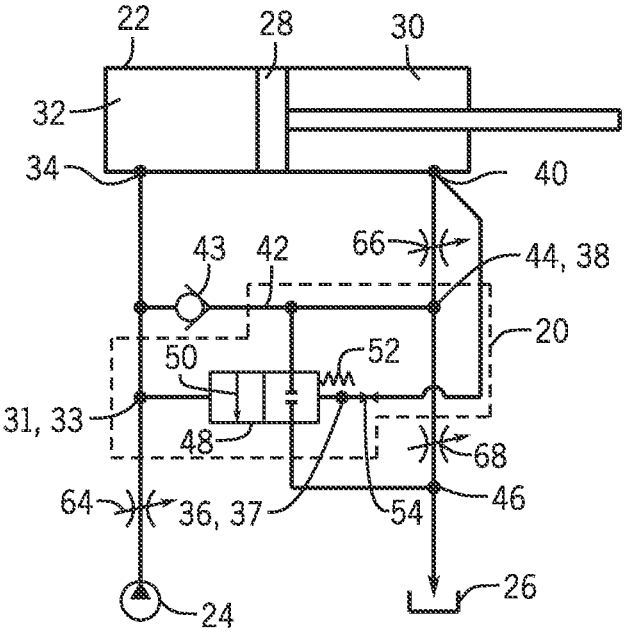

FIG. 6 is similar to FIG. 1, except that the reference node 37 is shown connected to the return workport 40. The reference pressure 36 will be higher than the pressure at the regeneration node 44, which feeds the regeneration fluid path 42. In this arrangement, the flow control valve 48 can sense a pressure differential closer to the pressure differential between the cylinder rod chamber 30 and the head chamber 32. When a pressure at the driving workport 34 becomes higher than a pressure at regeneration node 44, check valve 43 will close preventing regeneration flow, but the regeneration deactivation valve 20 will not shift until a pressure at the return workport 40 becomes higher than a pressure at the driving workport 34. This arrangement can set up a delay in the regeneration deactivation valve shifting that can help stabilize the hydraulic circuit. As discussed above, orifice 54 can serve as a damping orifice.

Figure 7:
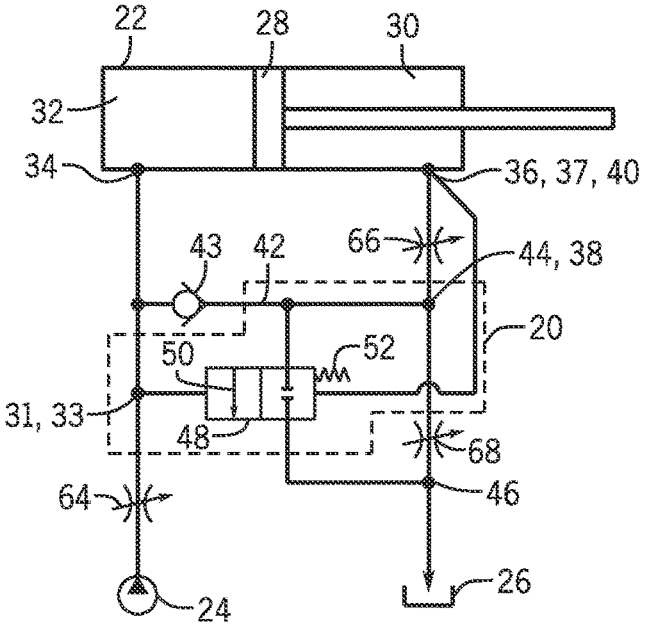

FIG. 7 is similar to FIG. 6, except without the damping orifice 54.

Figure 8:
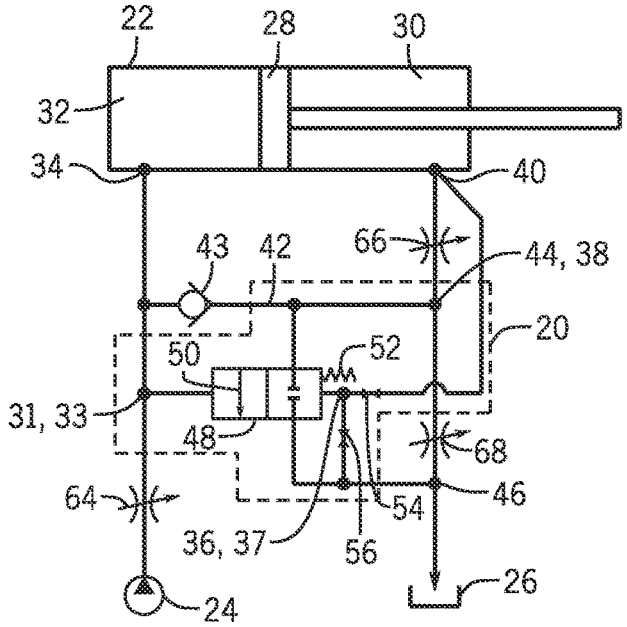

FIG. 8 is similar to FIG. 5, except that the reference node 37 is shown connected to the return workport 40 rather than from the regeneration gallery 38. This hydraulic circuit can have the same advantages as the hydraulic circuits of FIGS. 5 and 6.

Figure 9:
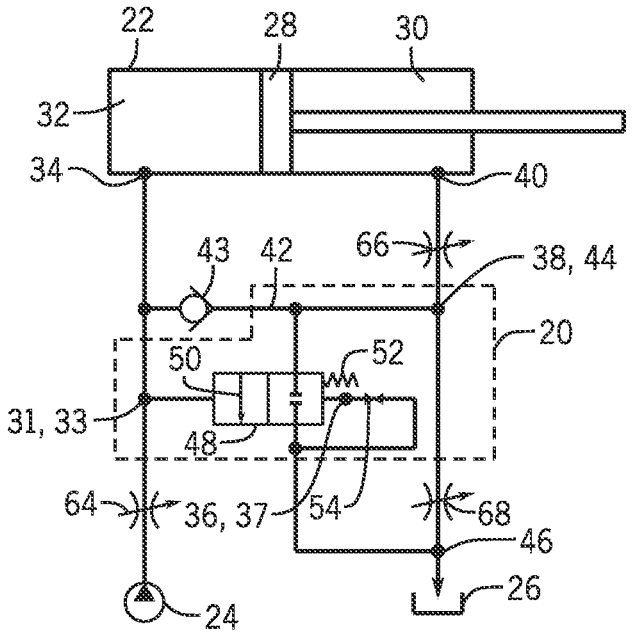

FIG. 9 is similar to FIG. 1, except the reference pressure 36 is shown connected to the tank return node 46. In this arrangement, the regeneration deactivation valve 20 can shift if the force due to the difference between a pressure in the driving work port 34 and the tank return node 46 exceeds the preload on spring 52.

Figure 10:
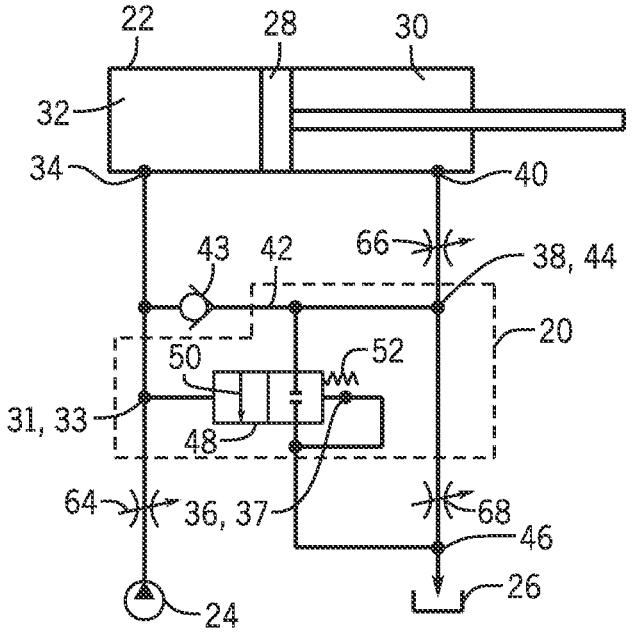

FIG. 10 is similar to FIG. 9, except without the damping orifice 54.

The regeneration deactivation valve 20 can be used any time regeneration of a cylinder is possible, including either extension or retraction of the cylinder.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A hydraulic control valve comprising:

a control valve body having a spool bore therein, a supply node for connection to a fluid source, a tank return node for connection to a tank, a driving workport for connection to a first chamber of a double-acting hydraulic cylinder, a return workport for connection to a second chamber of the double-acting hydraulic cylinder, and a regeneration node, wherein the first chamber and the second chamber are separated by a piston, and the regeneration node is configured to provide a connection between the driving workport and the return workport;

a spool slidably received in the spool bore and having a spool first position in which a first metered fluid path is provided between the supply node and the driving workport, a second metered fluid path is provided between the return workport and the regeneration node, a third metered fluid path is provided between the regeneration node and the tank return node, and a flow control path is provided between the regeneration node and the tank return node in parallel with the third metered fluid path, a spool second position in which a fourth fluid path is provided between the driving workport and the tank return node, a fifth fluid path is provided between the supply node and the return workport, and the second fluid path between the return workport and the regeneration node is closed, and a spool neutral position in which the driving workport and the return workport are both closed off from all of the supply node, the regeneration node, and the tank return node;

a flow control valve arranged on the flow control path within the spool and selectively movable between a flow control first position and a flow control second position, wherein when the spool is in the spool first position, the flow control path being restricted in the flow control first position, and the flow control path being substantially unrestricted in the flow control second position; and the flow control valve responsive to a sense pressure in the driving workport to move between the flow control first position and the flow control second position.

2. The hydraulic control valve according to claim 1, wherein a regeneration fluid path between the regeneration node and the driving workport includes a check valve to prevent the reverse flow of fluid from the driving workport to the return workport.

3. The hydraulic control valve according to claim 1, further including a valve spring, the valve spring to bias the flow control valve.

4. The hydraulic control valve according to claim 1, wherein the first metered fluid path is metered by a first variable orifice configured to meter flow from the fluid source to the driving workport, the second metered fluid path is metered by a second variable orifice configured to meter flow from the return workport, and the third fluid path is metered by a third variable orifice configured to meter flow to the tank.

5. The hydraulic control valve according to claim 1, wherein the flow control valve is responsive to a differential pressure between the sense pressure in the driving workport and a reference pressure.

6. The hydraulic control valve according to claim 5, wherein the reference pressure is connected to the return workport.

7. The hydraulic control valve according to claim 6, further including a reference node directly connected to the flow control valve, and a first orifice between the return workport and the reference node, the reference pressure coming from the reference node.

8. The hydraulic control valve according to claim 7, further including a second orifice between the reference node and the tank return node.

9. The hydraulic control valve according to claim 5, wherein the reference pressure is connected to sense a pressure between a variable orifice and the tank node, the variable orifice connected to the return workport.

10. The hydraulic control valve according to claim 9, further including a reference node directly connected to the flow control valve, and a first orifice between the variable orifice and the reference node, the reference pressure coming from the reference node.

11. The hydraulic control valve according to claim 10, further including a second orifice between the reference node and the tank return node.

12. The hydraulic control valve according to claim 5, wherein the reference pressure is connected to the tank return node.

13. The hydraulic control valve according to claim 12, further including a reference node directly connected to the flow control valve, and a first orifice between the reference node and the tank return node, the reference pressure coming from the reference node.

14. A hydraulic valve for a hydraulic circuit, the hydraulic circuit including a pump, a tank, and a hydraulic cylinder within which a piston is slidably received thereby forming a rod chamber and a head chamber, the hydraulic valve comprising:

a control valve body defining a spool bore therein and including an inlet in fluid communication with the pump, an outlet in fluid communication with the tank, a first workport in fluid communication with the head chamber, a second workport in fluid communication with the rod chamber, a regeneration workport in fluid communication with the head chamber, and a regeneration node providing fluid communication between the second workport and the regeneration workport;

a spool slidably received within the spool bore and selectively movable between a spool first position and a spool second position, wherein the first spool position provides a first metered fluid path between the inlet and the first workport, a second metered fluid path between the second workport and the regeneration workport, a third metered fluid path between the second workport and the outlet, and a flow control path between the second workport and the outlet arranged in parallel with the third metered fluid path, and wherein the second spool position provides a fourth fluid path between the inlet and the second workport, a fifth fluid path between the first workport and the outlet, and the second fluid path is closed; and a flow control valve arranged on the flow control path within the spool and selectively movable between a flow control first position where the flow control valve provides a first restriction and a flow control second position where the flow control valve provides a second restriction less than the first restriction, wherein the flow control valve is movable between the first flow control position and the second flow control position in response to a pressure at the first workport.

15. The hydraulic control valve according to claim 14, wherein a regeneration path is in fluid communication with the regeneration node and extends between the regeneration workport and the head chamber, the regeneration path including a check valve to prevent fluid from flowing in a direction from the head chamber to the regeneration workport.

16. The hydraulic control valve according to claim 14, further including a valve spring, the valve spring to bias the flow control valve.

17. The hydraulic control valve according to claim 14, wherein the first metered fluid path is metered by a first variable orifice configured to meter flow from the fluid source to the first workport, the second metered fluid path is metered by a second variable orifice configured to meter flow from the second workport, and the third fluid path is metered by a third variable orifice configured to meter flow to the tank.

18. The hydraulic control valve according to claim 14, wherein the flow control valve is responsive to a differential pressure between a sense pressure at the first workport and a reference pressure.

19. The hydraulic control valve according to claim 18, wherein the reference pressure is connected to the second workport.

20. The hydraulic control valve according to claim 19, further including a reference node directly connected to the flow control valve, and a first orifice between the second workport and the reference node, the reference pressure coming from the reference node.

21. The hydraulic control valve according to claim 20, further including a second orifice between the reference node and the outlet.

22. The hydraulic control valve according to claim 18, wherein the reference pressure is connected to sense a pressure between of a variable orifice and the outlet, the variable orifice connected to the second workport.

23. The hydraulic control valve according to claim 22, further including a reference node directly connected to the flow control valve, and a first orifice between the variable orifice and the reference node, the reference pressure coming from the reference node.

24. The hydraulic control valve according to claim 23, further including a second orifice between the reference node and the outlet.

25. The hydraulic control valve according to claim 18, wherein the reference pressure is connected to the outlet.

26. The hydraulic control valve according to claim 25, further including a reference node directly connected to the flow control valve, and a first orifice between the reference node and the outlet, the reference pressure coming from the reference node.

* * * * *